US005740689A

United States Patent [19]

Chu

[11] Patent Number: 5,740,689

[45] Date of Patent: Apr. 21, 1998

[54] WHEEL SPOKE EXTRUSION STRETCHER

[76] Inventor: Yen-Shun Chu, 40 San-Min Rd., Lin 10, Pei-Lung Li, Hou-Lung Chen, Miao-Li Hsien, Taiwan

[21] Appl. No.: 864,908

[22] Filed: May 29, 1997

[51] Int. Cl.[6] ..... B32F 39/00

[52] U.S. Cl. ..... 72/294; 72/302; 72/403; 72/424; 140/1; 29/34 D

[58] Field of Search ..... 72/294, 302, 305, 72/403, 424; 140/1, 123.6; 29/34 D; 414/797.8, 797.9

[56] References Cited

U.S. PATENT DOCUMENTS

| | | | |
|---|---|---|---|
| 617,270 | 1/1899 | Baldwin | 72/294 |
| 1,518,869 | 12/1924 | Olson | 72/424 |
| 1,826,350 | 10/1931 | Hawk | 72/403 |
| 1,865,412 | 6/1932 | Geist | 29/34 D |
| 3,123,846 | 3/1964 | Prutton | 72/294 |

FOREIGN PATENT DOCUMENTS

| | | | |
|---|---|---|---|
| 566991 | 1/1945 | United Kingdom | 72/403 |

*Primary Examiner*—Daniel C. Crane

[57] ABSTRACT

A wheel spoke extrusion stretcher including a main shaft turned by a motor through a belt transmission mechanism, two driven shafts turned by said main shaft through helical gears, a main sliding block coupled to the driven shafts by a crank and holding an eye block die and a tool block, two transmission shafts coupled to the driven shafts by bevel gears and mounted with cam wheels, two sets of chucks respectively mounted on respective transverse sliding blocks and moved by the cam wheels to seize workpiece, a swing link turned to pick up workpiece from a feed plate by jaw chucks, and a swing arm turned about an axle by one cam wheel and having a hammer bit at one end, wherein when workpiece is picked up and gripped by the chucks, the main sliding block is moved forwards to force the eye block die onto workpiece, and then the chucks are opened in proper order as the eye block die is moved forwards, and then the hammer bit of the swing arm is moved downwards to hit the tool block, causing it to cut off workpiece.

1 Claim, 9 Drawing Sheets

WHEEL SPOKE EXTRUSION STRETCHER

BACKGROUND OF THE INVENTION

The present invention relates to a wheel spoke extrusion stretcher specifically designed for processing wire rods into stepped wheel spokes.

Conventionally, screw head processing machines are used for processing wire rods into stepped wheel spokes. Because these screw head processing machines are not specifically designed for processing wire rods into stepped wheel spokes, the processing speed is slow.

SUMMARY OF THE INVENTION

The present invention has been accomplished to provide a machine which is specifically designed for processing wire rods into stepped wheel spokes. It is another object of the present invention to provide a wheel spoke extrusion stretcher which is practical for processing wire rods of different lengths and thickness into desired length and thickness. To achieve these and other objects of the present invention, there is provided a wheel spoke extrusion stretcher comprised of a main shaft turned by a motor through a belt transmission mechanism, two driven shafts turned by said main shaft through helical gears, a main sliding block coupled to the driven shafts by a crank and holding an eye block die and a tool block, two transmission shafts coupled to the driven shafts by bevel gears and mounted with cam wheels, two sets of chucks respectively mounted on respective transverse sliding blocks and moved by the cam wheels to seize workpiece, a swing link turned to pick up workpiece from a feed plate by jaw chucks, and a swing arm turned about an axle by one cam wheel and having a hammer bit at one end, wherein when workpiece is picked up and gripped by the chucks, the main sliding block is moved forwards to force the eye block die onto workpiece, and then the chucks are opened in proper order as the eye block die is moved forwards, and then the hammer bit of the swing arm is moved downwards to hit the tool block, causing it to cut off workpiece.

DETAILED DESCRIPTION OF THE PREFERRED EMBODIMENT

Figure 1:
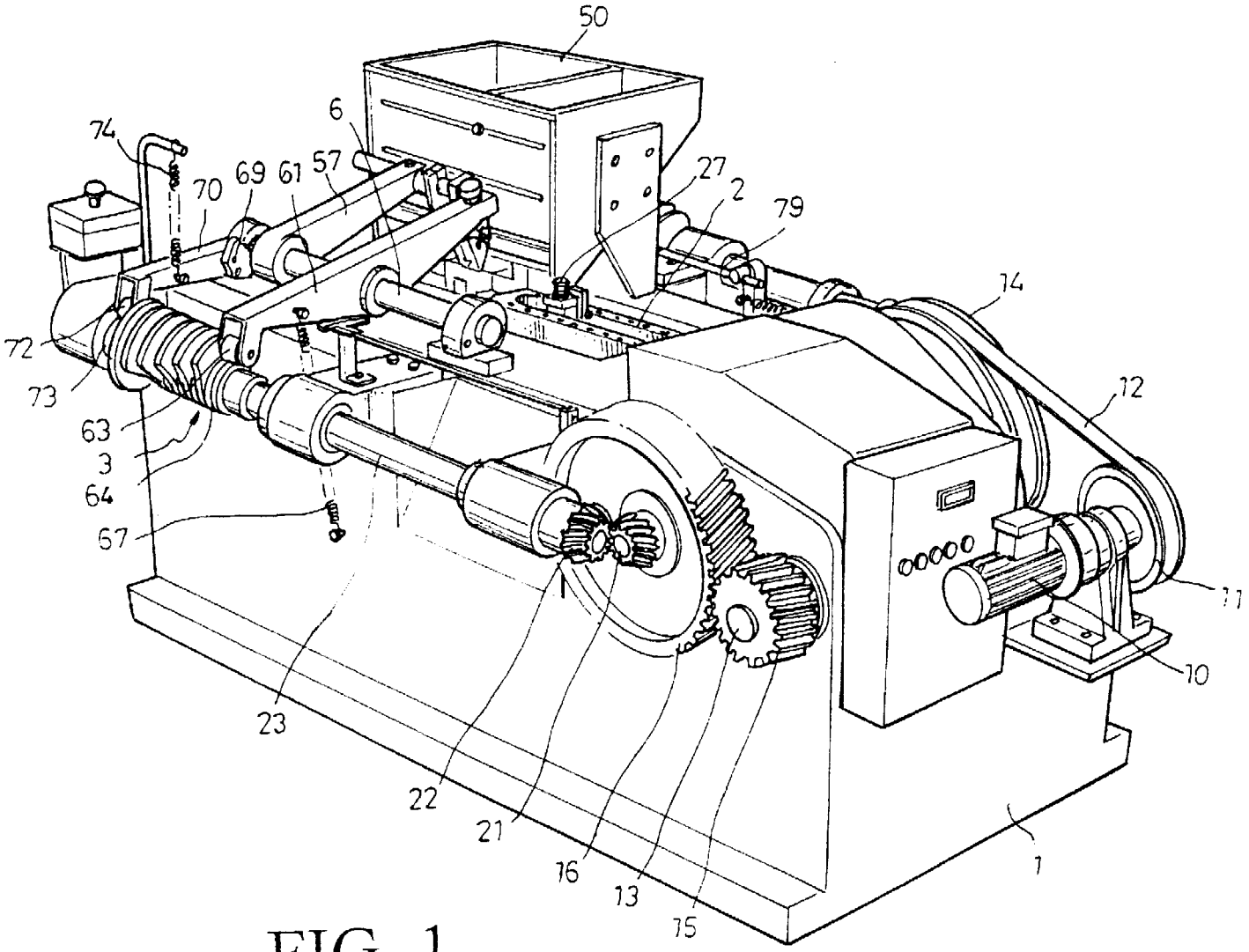
FIG. 1 is a perspective elevational view of a wheel spoke extrusion stretcher according to the present invention.
Figure 2:
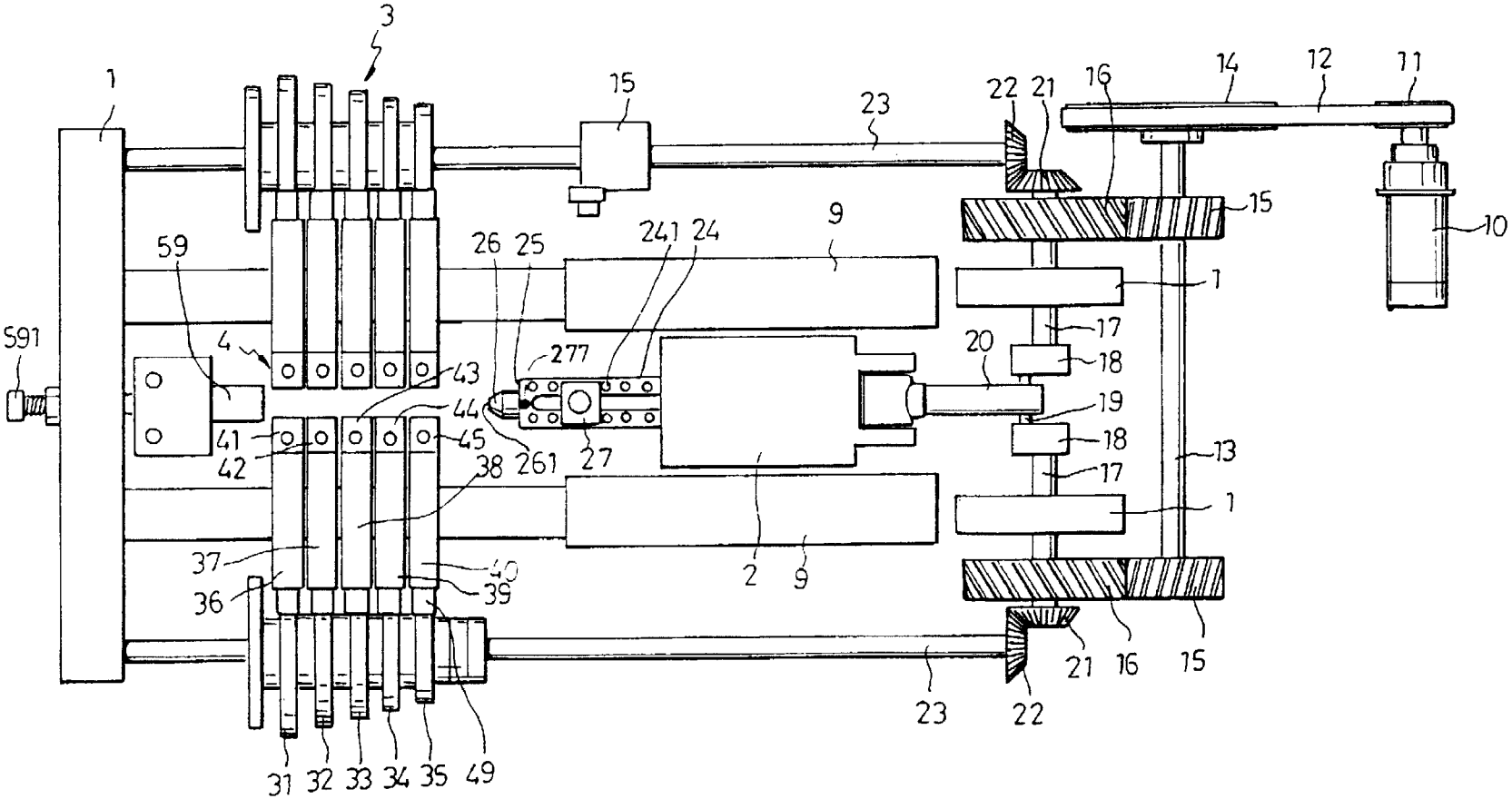
FIG. 2 is a top plain view of a part of the present invention, showing the arrangement of driving power transmission parts.

Referring to FIGS. from 1 to 10, a motor 10 is mounted on a machine base 1 at one side and controlled to turn a small belt pulley 11 through a reduction gear (not shown). A big belt pulley 14 is fixedly mounted on one end of a main shaft 13 and coupled to the small belt pulley 11 by a transmission belt 12. Two small helical gears 15 are fixedly mounted on the main shaft 13 near its two opposite ends and turned with it. Two big helical gears 16 are mounted on a respective driven shat 17 on the machine base 1, and respectively meshed with the small helical gears 15. Two eccentric blocks 18 are respectively mounted on the driven shafts 17 at an inner end. A connecting rod 19 is connected between the eccentric blocks 18. A link 20 is provided having one end coupled to the connecting rod 19, and an opposite end coupled to a main sliding block 2 to form with it a crank mechanism. Two big bevel gears 21 are respectively mounted on the driven shafts 17 at an outer end. Two transmission shafts 23 are disposed at two opposite sides of the machine base 1. Two small bevel gears 22 are respectively mounted on the transmission shafts 23 at one end and respectively meshed with the big bevel gears 21. Two cam wheel sets 3 are respectively mounted on the transmission shafts 23 at one end remote from the small bevel gears 22.

Each cam wheel set 3 is comprised of a set of cam wheels 31;32;33;34;35 disposed in contact with a respective roller 49 at an outer end of a respective transverse sliding block 36;37;38;39;40. The transverse sliding blocks 36;37;38;39;40 have a respective inner end mounted with a respective chuck 41;42;43;44;45. The chucks 41;42;43;44;45 form a chuck unit 4. The sliding blocks 36;37;38;39;40 are moved on rack 9 in direction parallel to the main shaft 13. The number of the chucks can be as many as 8 to 10 pieces per set.

The main sliding block 2 comprises an U-frame 24 disposed at its front side and having two longitudinal rows of screw holes 241 at its top side, an eye block die 26 mounted on the front end 25 of the U-frame 24 and fixed in place by a screw 261, a tool block unit 27 sliding on the U-frame 24 at the top and fixed to the screw holes 241 at the desired location. The main sliding block 2 is longitudinally moved on the rack 9 toward the chuck unit 4.

Figure 3:
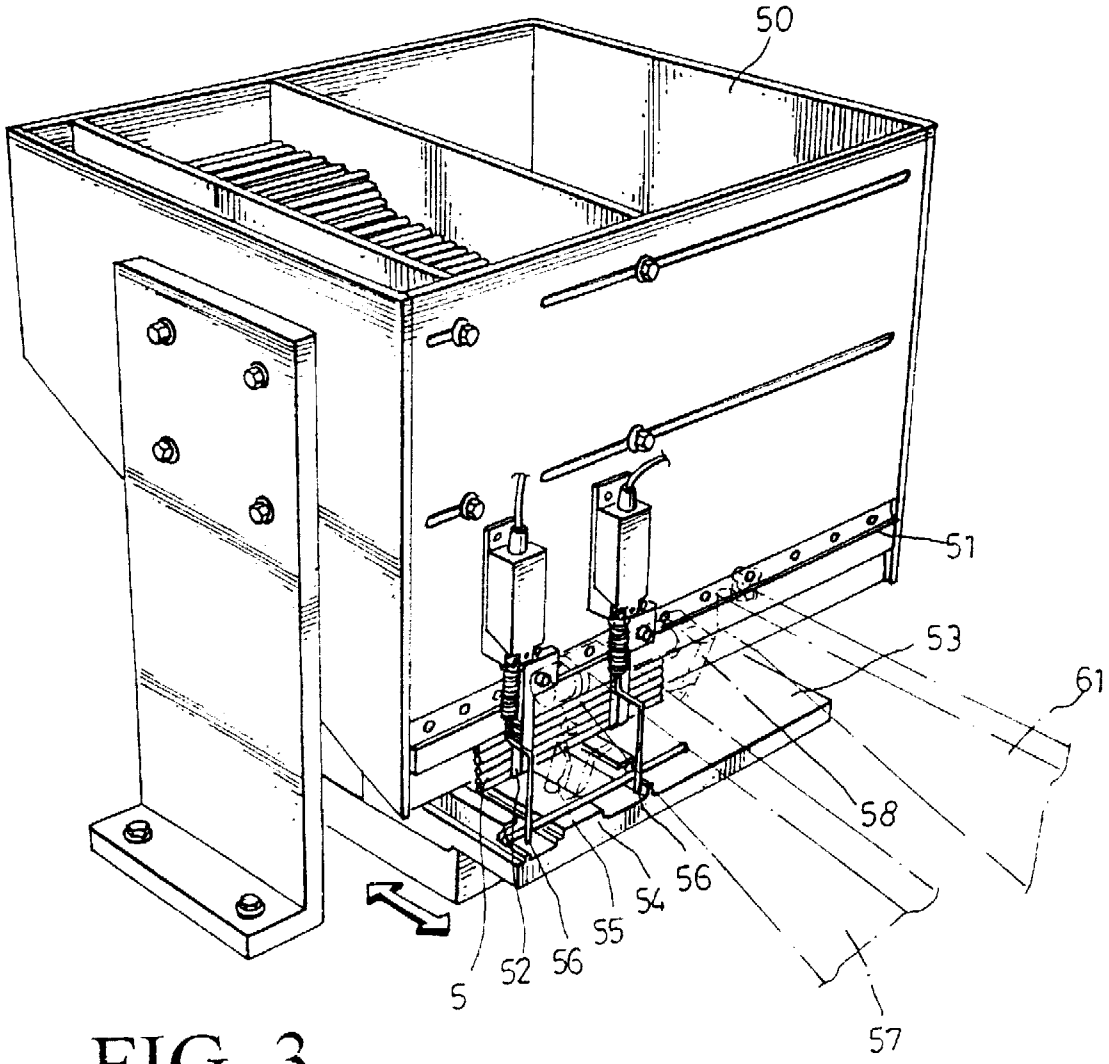
FIG. 3 is a perspective elevational view of the feed trough and feed plate of the feeding mechanism according to the present invention.
Figure 10:
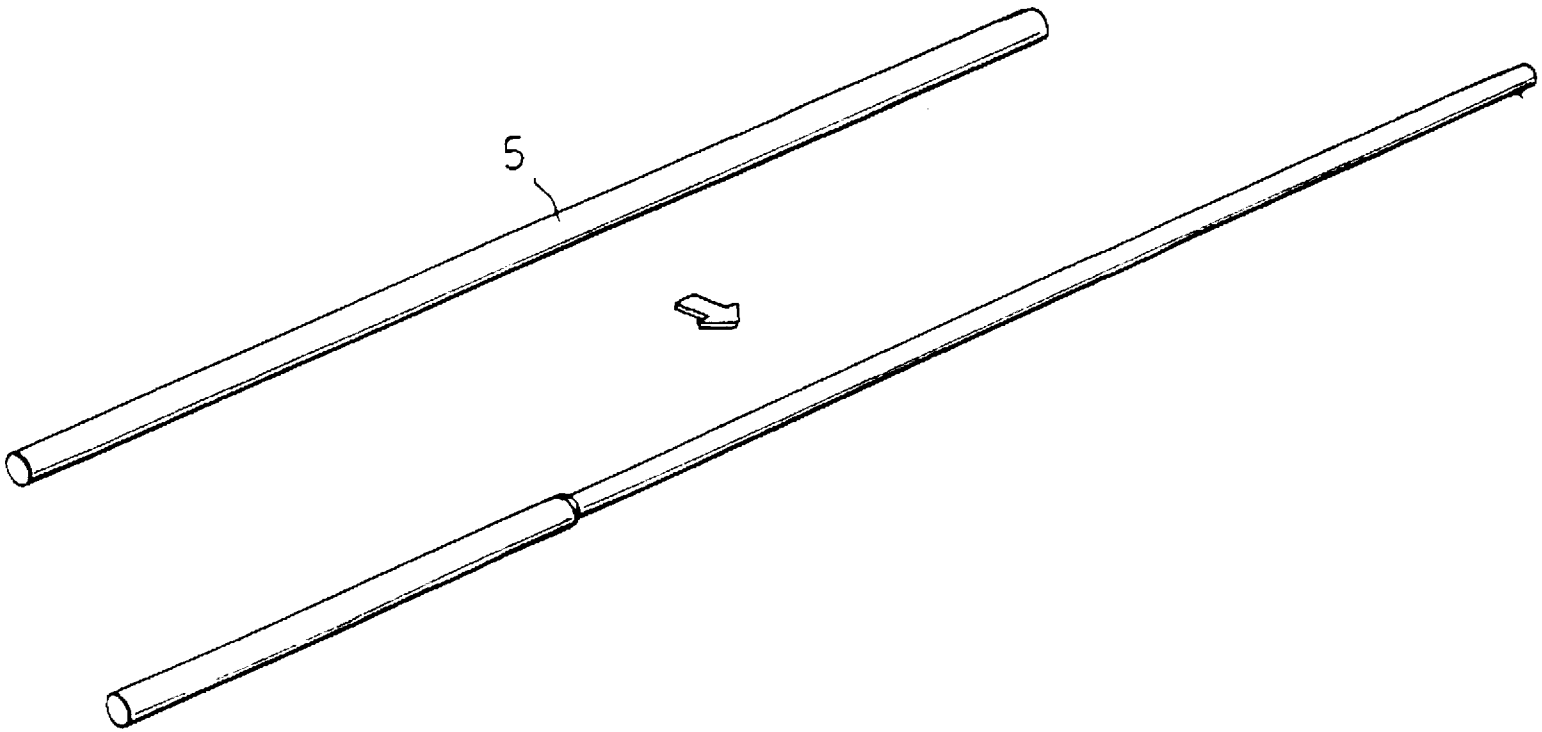
FIG. 10 shows a wire rod processed into a stepped wheel spoke according to the present invention.

Raw material for spokes, namely, wire rods 5 (see FIG. 10) are put in a feed trough 50. The feed trough 50 is fixedly mounted on the machine base 1 near its rear end above the chuck unit 4. As illustrated in FIG. 3, the feed trough 50 has a bevel bottom side, a transverse feed slot 51 horizontally disposed at the lowest side edge of its bevel bottom side through which wire rods 5 are guided out one by one, and bumper devices 52 disposed adjacent to the transverse feed slot 51 and adapted to stop wire rods 5 from moving out of the transverse feed slot 51 in a rush. A feed plate 53 is disposed below the feed trough 50, and adapted to carry an individual wire rod 5 to the processing position for processing. The feed plate 53 comprises a rail 54, a groove 53 intersecting the rail 54 and adapted for receiving an individual wire rod 5 from the transverse feed slot 51, and a pair of spring elements 56 adapted to hold an individual wire rod 5 in the groove 55. A pair of jaw chucks 58 are mounted on a swing link 57 near the feed trough 50. When an individual wire rod 5 is carried on the groove 55 of the feed plate 53, the jaw chucks 58 are swung downward to catch the wire rod 5. When the wire rod 5 is caught by the jaw chucks 58, the feed plate 53 is returned, and the swing link 57 keeps swinging downwards, permitting the caught wire rod 5 to be seized by the chuck unit 4. Further, a stop block 59 is fastened to the machine base 1 at one end near one side of the chuck unit 4 by an adjustment screw 591, and adapted for stopping the caught wire rod 5 in position.

Figure 7:
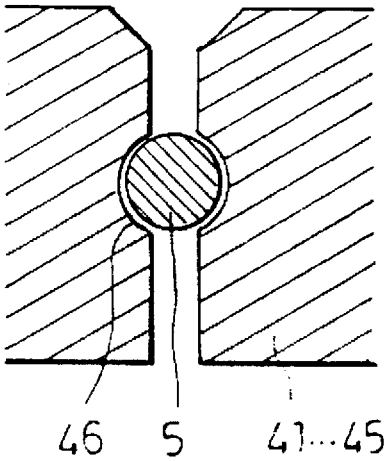
FIG. 7 is a sectional view of a part of the present invention, showing the workpiece retained between two chucks.

When the main sliding block 2 is moved toward the jaw unit 4, it pushes the wire rod 5 to the stop block 59. Further, the chucks 41–45 have a respective U-groove 46 adapted for receiving the wire rod 5 to be processed (see FIG. 7). The eye block die 26 is longitudinally aligned with longitudinal central axis of the wire rod 5, so that the rear end of the wire rod 5 can be forced into the eye block die 26 and then stretched. Most chucks of the chuck unit 4 are opened in proper order so that the eye block die 26 can be moved into the chuck unit 4 at a predetermined distance. The first chucks 41 are maintained closed so that the wire rod 5 can be firmly held down and stretched by the eye block die 26 into thinner section or sections. When the wire rod 5 is properly stretched, a swing arm 61 swings downward and presses on the tool block unit 27, causing it to cut off the thick rear end of wire rod 5 at the desired length, and therefore a processed wire rod 5 is obtained. After cutting, the main sliding block 2 is returned to its former initial position, and at the same time the first chucks 41 are opened to let the processed wire rod 5 fall. The aforesaid processing procedure is repeated again and again until the individual wire rods 5 are all processed.

Figure 6:
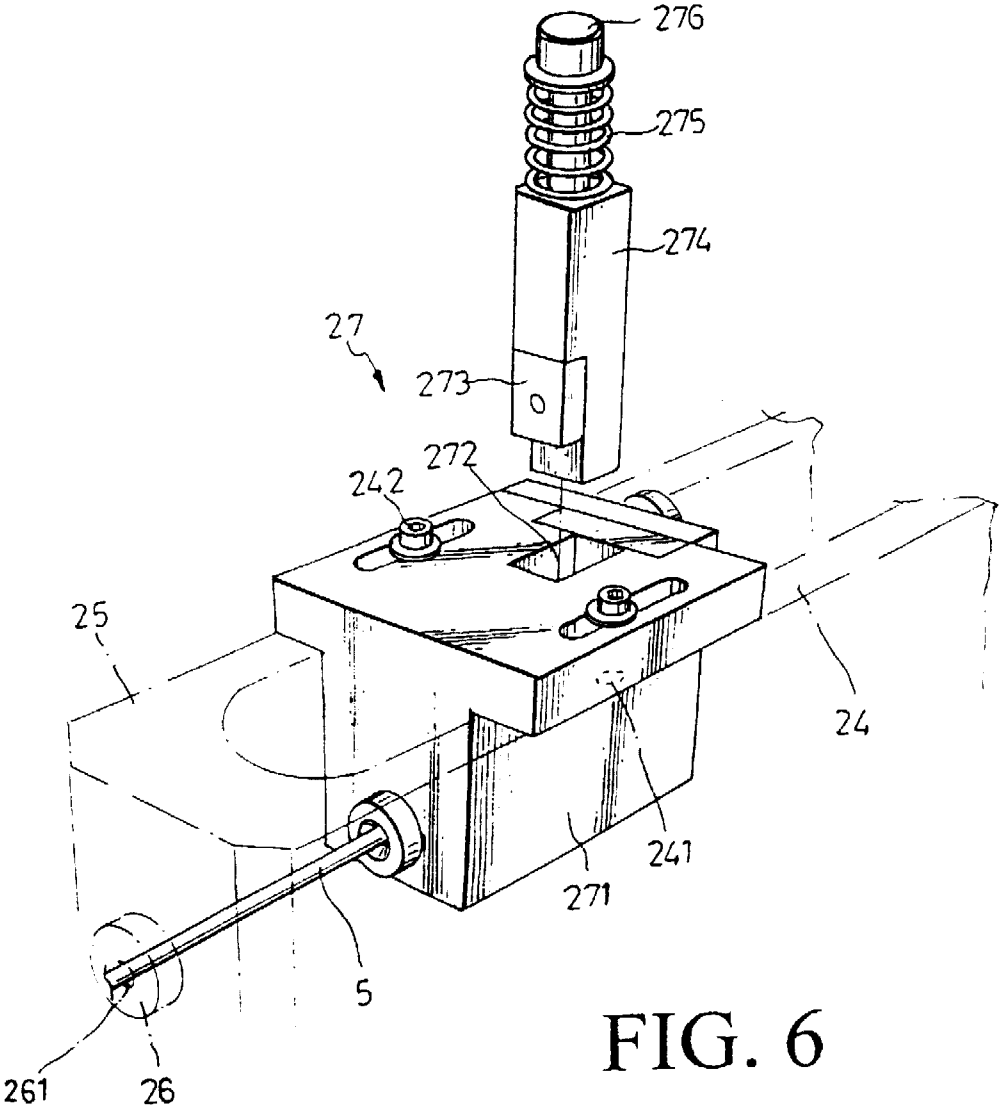
FIG. 6 is a perspective view of a part of the present invention, showing the structure of the tool block.
Figure 8:
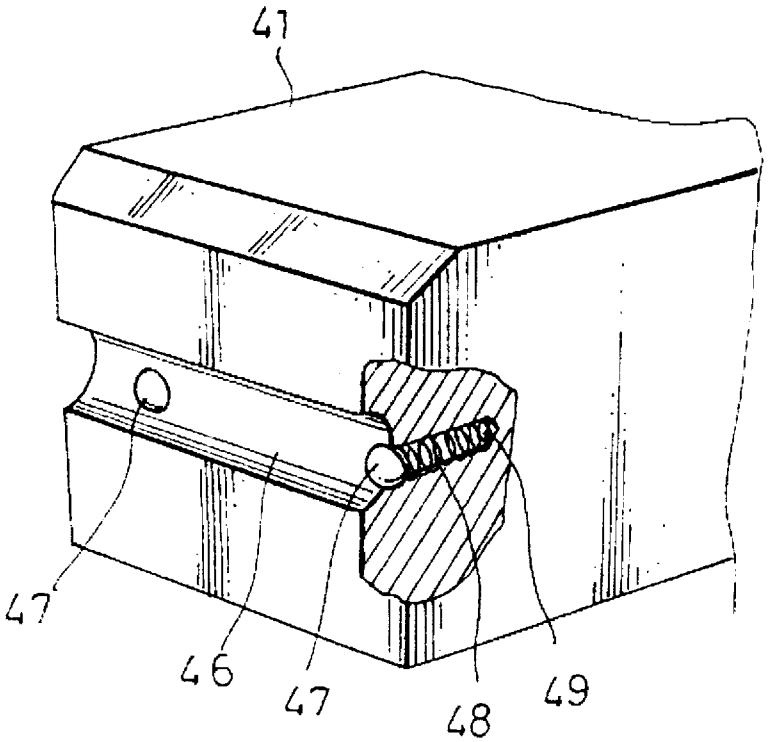
FIG. 8 shows the structure of one first chuck according to the present invention.

Referring to FIG. 6, the tool block unit 27 comprises a block base 271 fastened to the screw holes 241 of the U-frame 24 of the main sliding block 2 by screws 242 and having a vertical through hole 272 and a horizontal hole 261 in alignment with the eye block die 26 and in communication with the vertical through hole 272 for receiving the rear end of the wire rod 5, a tool bar 274 inserted into the vertical through hole 272 and having a head 276 disposed outside the block base 271, a cutting tool 273 fixedly fastened to the tool bar 274 at the bottom, and a compression spring 275 mounted around the tool bar 274 and stopped above the block base 271 to support the head 276 above the block base 271.

Figure 5:
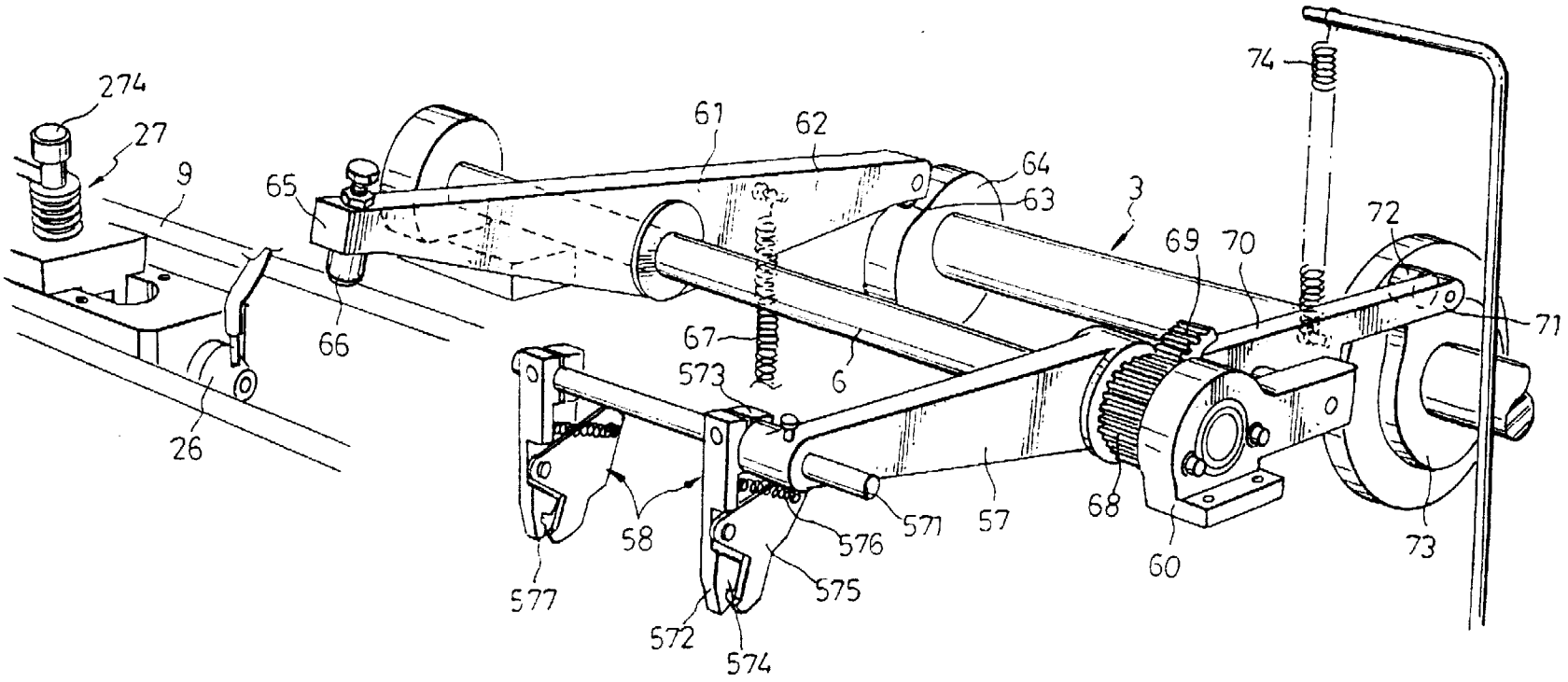
FIG. 5 is a perspective view of a part of the present invention, showing the arrangement of the swing link and the swing arm on the axle.

Referring to FIG. 5, the swing arm 61 is turned about an axle 6, having one end 62 mounted with a roller 63 disposed in contact with one cam wheel 64 of the cam wheel set 3, and an opposite end 65 mounted with a hammer bit 66. When the peak of the cam wheel 64 touches the roller 63, the hammer bit 66 is forced downwards against the head 276 of the tool bar 274, thereby causing the cutting tool 273 to cut off the rear end of the wire rod 5. Because both ends of the wire rod 5 are firmly held down, it can be conveniently cut. After cutting, the swing arm 61 is returned to its former position by a return spring 67.

The axle 6 has two opposite ends respectively connected to two axle mounts 60, which are fixedly fastened to the machine base 1 in front of the feed trough 50. The swing link 57 has one end pivoted to the axle 6 and fixedly mounted with a gear 68. The gear 68 is meshed with a gear block 69. The gear block 69 is connected to one end of a rod 70. The rod 70 has an opposite end 71 mounted with a roller 72, which is disposed in contact with a cam wheel 73 of the cam wheel set 3. When the cam wheel 73 is turned, the gear block 69 is moved with the rod 70, thereby causing the gear 68 and the swing link 57 to turn downwards in executing a workpiece clamping operation. A return spring 74 is provided and suspended from an upright stand above the machine base 1 to hold the rod 70. After each turn, the rod 70 is immediately returned to its former position by the return spring 74.

The opposite end of the swing link 57 is mounted with a round rod 571 at right angles, which holds the jaw chucks 58. Each jaw chuck 58 comprises a pair of jaw plates, namely, the front jaw plate 572 and the rear jaw plate 573. The front jaw plate 572 comprises a fixed jaw tip 574, a movable jaw tip 575 moved relative to the fixed jaw tip 574, and a spring 576 connected between the movable jaw tip 575 and the front jaw plate 573. The fixed jaw tip 574 has a notch 577 adapted for receiving the workpiece, namely, the wire rod 5.

Figure 9:
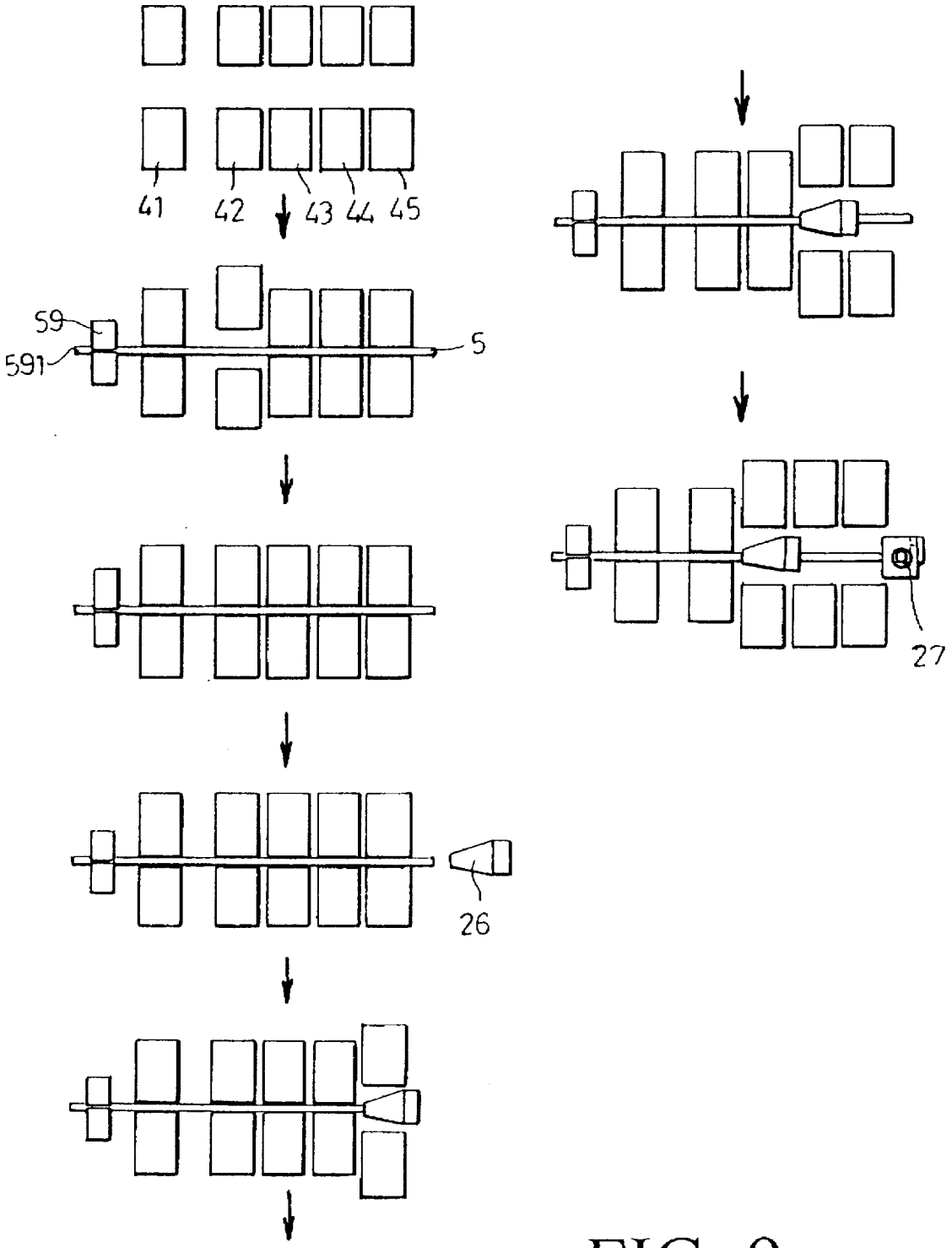
FIG. 9 illustrates the operation procedure of the eye block die and the chuck units according to the present invention.

When the wire rod 5 is seized by the fixed jaw tip 574 and the movable jaw tip 575, it is moved to the chuck unit 4, as shown in FIG. 9, then gripped by the chucks of the chuck unit 4 other than the second chucks 42, and then the jaw chucks 58 are returned with the swing link 57, permitting the second chucks 42 to grip the wire rod 5, and then the main sliding block 2 is moved forwards to push the wire rod 5 to the stop block 59, permitting the rear end of the wire rod 5 to be forced into the eye block die 26 and then stretched, and then the chucks 42;43;44;45 are opened one after another in reversed order. When the wire rod 5 is properly stretched, the main sliding block 2 is moved to the end of the stroke, then the swing arm 6 is turned to move down the hammer bit 66, causing it to press on the tool bar 274 in a rush, and therefore the wire rod 5 is cut to the desired length. After cutting, the main sliding block 2 is returned, and the first chucks 41 are opened, and the processed wire rod 5 is ejected out of the U-groove 46 of the first chucks 41 by steel balls 47, which are supported on a respective spring 48 in a respective hole 49 in the U-grooves 46 of the first chucks 41. When the processed wire rod 5 falls out of the chuck unit 4, it is delivered out of the machine base 1 and collected.

Figure 4:
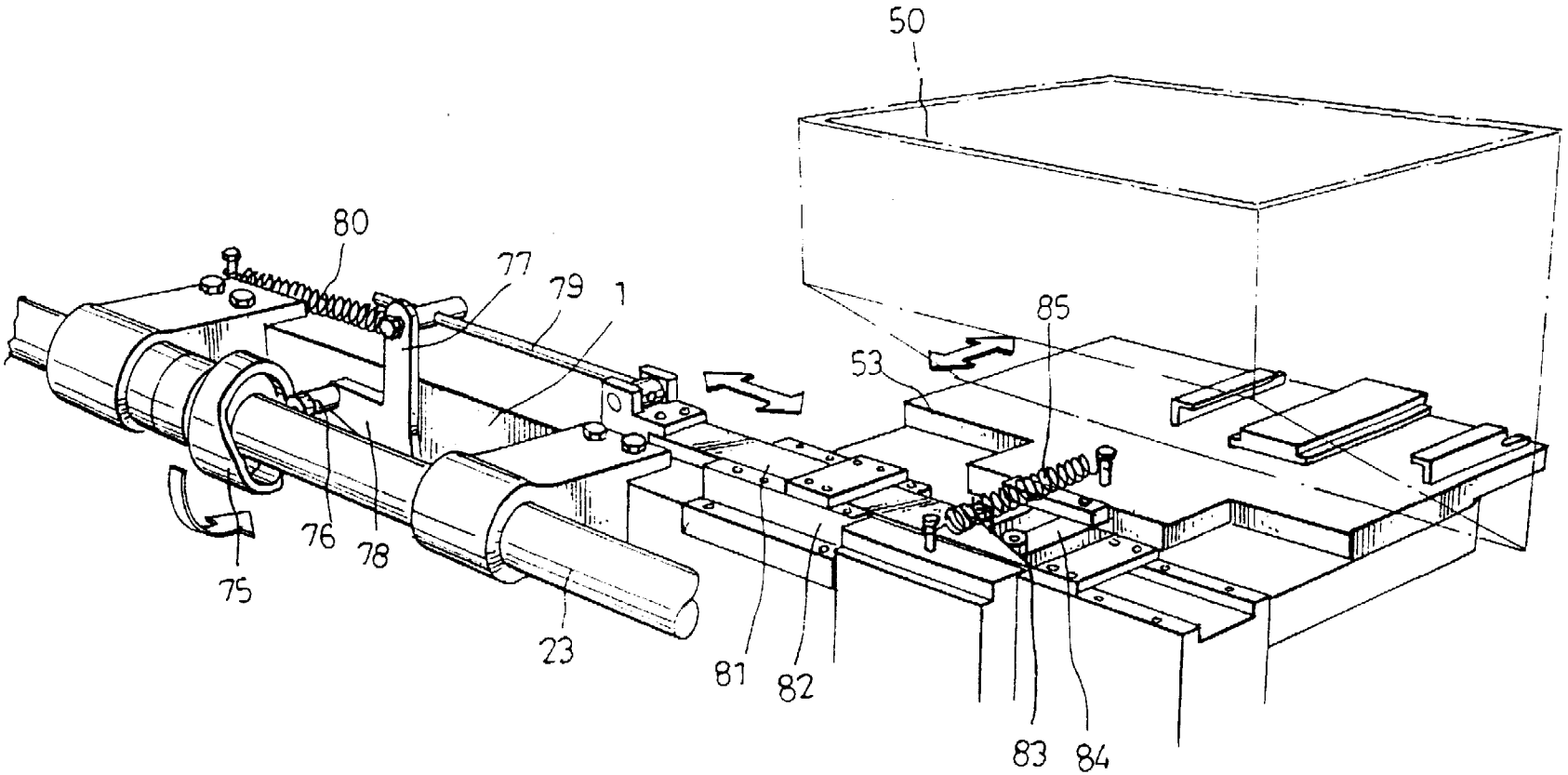
FIG. 4 is a perspective rear side view of the feeding mechanism according to the present invention.

When the processed wire rod falls, the swing link 57 is turned to seize a second wire rod 5, and the material feeding mechanism starts again (see FIG. 4). Further, a cam wheel 75 is mounted on one transmission shaft 23 within the corresponding cam wheel set 3 and disposed in contact with a roller 76. The roller 76 is mounted on a middle projecting rod 76 of a rocker 7. The rocker 7 has one end pivoted to the machine base 1, and an opposite end connected to the machine base 1 by a spring 80 at one side and coupled with an extension rod 79 at an opposite side. The opposite end of the extension rod 79 is connected to an elongated sliding block 81. The elongated sliding block 81 is moved in a sliding way 82 below the feed trough 50. The sliding way 82 is disposed in parallel to the moving direction of the longitudinal sliding block 2. The elongated sliding block 81 has a bevel guide face 83 stopped at a guide rod 84. The guide rod 84 is connected to a rear side of the feed plate 53. When the elongated sliding block 81 is moved forwards, the guide rod 84 is forced to push out the feed plate 53, permitting the wire rod 5 to be seized by the jaw chucks 58. When the wire rod 5 is caught by the jaw chucks 58 of the swing link 57, the elongated sliding block 81 is returned, and the feed plate 53 is pulled back by a spring 85. The feed plate 56 and the swing link 57 are operated synchronously.

As indicated above, the present invention uses a crank mechanism to reciprocate a main sliding block in performing workpiece stretching operation, and cam wheel sets to control the operation of chuck units in seizing workpiece and the operation of a tool block in cutting workpiece.

While only one embodiment of the present invention has been shown and described, it will be understood that various modifications and changes could be made thereunto without departing from the spirit and scope of the invention disclosed.

What the invention claimed is:

1. A wheel spoke extrusion stretcher comprising:

a machine base;

a motor mounted on said machine base at one end and having a reduction gear coupled thereto;

a belt transmission unit turned by said reduction gear, said belt transmission unit comprising a small belt pulley coupled to said reduction gear, a big belt pulley, and a transmission belt mounted on said small belt pulley and said big belt pulley;

a main shaft mounted on said machine base and turned by said belt transmission unit, having two small helical gears fixedly mounted thereon at two opposite ends;

two driven shafts mounted on said machine base in parallel to said main shaft and turned by said main shaft, each driven shaft being fixedly mounted with a big bevel gear at an outer end, an eccentric block at an inner end, and a big helical gear adjacent to said big bevel gear, the big helical gears of said driven shaft being meshed with the small helical gears of said main shaft respectively;

a crank mechanism, said crank mechanism comprising a connecting rod connected between the eccentric blocks of said driven shafts and disposed in parallel to said main shaft, a main sliding block reciprocated on a rack on said machine base and having a front side terminating in a U-frame and a rear side coupled to said connecting rod, and a link coupled between said connecting rod and the rear side of said main sliding block, said U-frame having two longitudinal rows of screw holes at a top side thereof;

two transmission shafts mounted on said machine base at two opposite sides and turned by the big bevel gears of said driven shafts respectively, said transmission shafts having a respective small bevel gear fixedly disposed at one end and respectively meshed with the big bevel gears of said driven shafts;

two sets of cam wheels of different sizes respectively mounted on said transmission shafts remote from said small bevel gears, and turned with said transmission shafts;

two sets of transverse sliding blocks transversely moved on said machine base between said transmission shafts;

two chuck units respectively mounted on said transverse sliding blocks at an inner side, each unit comprising a plurality of chucks, each chuck having a groove for holding a workpiece and two spring-supported steel balls in a respective hole in the groove for ejecting a workpiece;

two sets of rollers respectively mounted on said transverse sliding blocks at an outer side and respectively disposed in contact with said sets of cam wheels;

an eye block die mounted in the U-frame of said main sliding block and having a conical front end and a center hole disposed perpendicular to said main shaft;

a tool block fastened to said main sliding block and controlled to cut a workpiece to the desired length, said tool block comprising a block base fastened to the screw holes of the U-frame of said main sliding block by screws and having a vertical through hole and a horizontal hole in alignment with said eye block die and in communication with said vertical through hole for receiving a workpiece, a tool bar inserted into said vertical through hole and having a head disposed outside said block base, a cutting tool fixedly fastened to said tool bar at a bottom side, and a compression spring mounted around said tool bar and stopped above said block base to support the head of said tool bar above said block base;

a feed trough fixedly mounted on said machine base above said chuck units and adapted for receiving and feeding workpieces, said feed trough having a bevel bottom side, a transverse feed slot horizontally disposed at the lowest side edge of its bevel bottom side through which workpieces are guided out one by one, and bumper devices disposed adjacent to said transverse feed slot and adapted to limit the output of workpieces from said transverse feed slot;

a feed plate disposed below said feed trough, and adapted to carry workpieces one after another from said feed trough to a processing position for processing;

an axle longitudinally mounted on said machine base between said cam wheel sets;

a swing link adapted for gripping workpiece, said swing link having a fixed end pivoted to said axle and a free end mounted with a round rod and two jaw chucks on said round rod, each of said jaw chucks comprising a front jaw plate and the rear jaw plate, said front jaw plate comprising a fixed jaw tip, a movable jaw tip moved relative to said fixed jaw tip, and a spring connected between said movable jaw tip and said front jaw plate, the fixed end of said swing link being fixedly mounted with a gear meshed with a gear block at one end of a linking rod, said linking rod being suspended from an upright stand above said machine base by a return spring and having an opposite end mounted with a roller disposed in contact with one cam wheel of one of said cam wheel sets, said linking rod being forced by the corresponding cam wheel to turn said swing link up and down alternatively, causing said jaw chucks to pick up a workpiece from said feed plate, permitting caught a workpiece to be seized by said chuck units;

a swing arm turned about said axle, having one end mounted with a roller disposed in contact with one cam wheel of one of said cam wheel sets, and an opposite end mounted with a hammer bit, said swing arm being turned by the corresponding cam wheel to force said hammer bit downwards, causing it to hit said tool block in cutting a workpiece;

a feeding mechanism controlled to move said feed plate, permitting a loaded workpiece to be picked up from said feed plate by said jaw chucks, said feeding mechanism comprising a cam wheel mounted on one transmission shaft, a rocker having a first end pivoted to said machine base and a second end connected to said machine base by a spring and a projecting rod disposed in the middle and mounted with a roller in contact with the cam wheel of said feeding mechanism, an elongated sliding block connected to the second end of said rocker by an extension rod and moved in a sliding way on said machine base below said feed trough, said elongated sliding block having a bevel guide face stopped at a guide rod at one side of said feed plate, said guide rod being forced to push out said feed plate when said elongated sliding block is moved forwards by said rocker, permitting a loaded workpiece to be picked up by said jaw chucks; and a stop block fastened to said machine base at one end near one side of the chuck units by an adjustment screw, and adapted for stopping a workpiece in the processing position.

* * * * *